United States Patent [19]

Bianchi et al.

[11] 4,084,734

[45] Apr. 18, 1978

[54] COMBINED SHOULDER AND BELT HOLSTER

[75] Inventors: John E. Bianchi; Richard D. E. Nichols, both of Fallbrook, Calif.

[73] Assignee: Bianchi Leather Products, Inc., Temecula, Calif.

[21] Appl. No.: 608,874

[22] Filed: Aug. 29, 1975

[51] Int. Cl.[2] ..... F41C 33/02

[52] U.S. Cl. ..... 224/2 B

[58] Field of Search ..... 224/2 B, 2 C, 2 D, 1 R, 224/5 R, 5 A, 26 R, 26 B, 5 H

[56] References Cited

U.S. PATENT DOCUMENTS

| | | | |
|---|---|---|---|
| 1,601,963 | 10/1926 | Arth | 224/2 B |
| 2,109,232 | 2/1938 | Hoyt | 224/2 B |
| 3,276,646 | 10/1966 | Coggins | 224/2 B |
| 3,630,420 | 12/1971 | Bianchi | 224/2 B |
| 3,804,306 | 4/1974 | Azurin | 224/2 B |
| 3,865,289 | 2/1975 | Boren | 224/2 B |
| 3,942,692 | 3/1976 | Chica | 224/2 B |

*Primary Examiner*—Trygve M. Blix
*Assistant Examiner*—Jerold M. Forsberg
*Attorney, Agent, or Firm*—John E. Wagner

[57] ABSTRACT

A holster which alternately may be worn as a shoulder holster under the armpit of the wearer with the weapon inverted or on a belt for front draw by either the right or left side. The holster employs a body which is folded to define a revolver pocket and a front opening held closed by a spring member. The spring includes a pair of legs which extend along opposite sides of the front opening and which spring legs extend up to the extreme corner of the holster body whereby the ends of the spring embrace and enclose the hammer of a revolver in the holster. The body includes two sets of generally arcuate openings defining two belt loops, one pair on each side of the holster. One ring for securement to a shoulder harness is retained by an integral extension of the body in the muzzle region. A second ring is secured to the body in the trigger guard region. Adjusting means for drawing the body sides together below the muzzle is employed.

6 Claims, 9 Drawing Figures

COMBINED SHOULDER AND BELT HOLSTER

REFERENCE TO RELATED APPLICATIONS

This invention is an improvement on the inventions of my prior patents 3,630,420, 3,749,293, 3,847,315, and my pending application, Ser. No. 492,757, filed July 29, 1974.

BACKGROUND OF THE INVENTION

The concept of a front opening holster including wire spring members having a pair of legs extending from a bight at the bottom of the holster to the upper region is disclosed in my U.S. Pat. No. 3,630,420, referenced above. This patented design plus the improvement shown in U.S. Pat. No. 3,749,293 has added a new dimension to the front opening holster in that uniform closing forces throughout the length of the holster are obtained allowing a smooth forward draw. This feature in combination with cylinder recesses to prevent the weapon from being drawn upward and out by other persons has resulted in a major safety feature. The value of an elongated wire spring for closing of the front opening is now well recognized.

In the field of shoulder holsters, it has been the common practice to support the weapon in the upright or horizontal position. One example of this appears in my U.S. Pat. No. 3,847,315. Other holsters have supported a short barrel revolver or automatics in an inverted position. Holsters designed for inverted mounting in this manner normally are withdrawn in an unnatural motion which is partly forward and partly down as compared with the front opening holster as disclosed in my U.S. Pat. Nos. 3,630,420 and 3,749,293 referenced above. Therefore it is apparent that the requirements of the two types of holsters are different and have never been reliably obtained in the same holster. Heretofore inverted shoulder holsters also suffered from the weakness of fatigue of elastic closures and of the leather, allowing the weapon to fall.

One additional limitation which has been prevalent in holsters of all designs except for that disclosed in my U.S. Pat. No. 3,847,315 is that the holsters are characteristically designed for one mode of operation on one side of the user.

BRIEF STATEMENT OF THE INVENTION

Given the foregoing state of the art, I have invented a new holster which:

a. is usable selectively as a shoulder holster or a belt worn holster;

b. is wearable either on the left or right side in either location;

c. operates effectively as a riot-proof front opening holster with withdrawal limited in an upward direction;

d. operates with the weapon inverted in the shoulder holster while allowing easy withdrawal of the weapon from the front side;

e. is significantly thinner than prior art shoulder or front opening holsters.

In addition to each of the foregoing features, I have designed the spring holster assembly so that the ends of the spring member in the upper corner of the holster extends upward to embrace the hammer of the weapon directly between the ends of the spring. This feature protects the hammer and rear sight at all times when the weapon is in the holster in either mode of wearing.

Further, I have designed the spring holster body arrangement whereby the spring bight portion is totally protected by leather from the weapon but without adding additional thickness to the holster.

One further feature involves a stop feature which provides a pivot for the weapon forward and outward on drawing when used in either mode.

BRIEF DESCRIPTION OF THE DRAWING

These features are all obtained in accordance with this invention and may be more clearly understood from the following detailed description and by reference to the drawing in which.

DETAILED DESCRIPTION OF THE INVENTION

Figure 1:
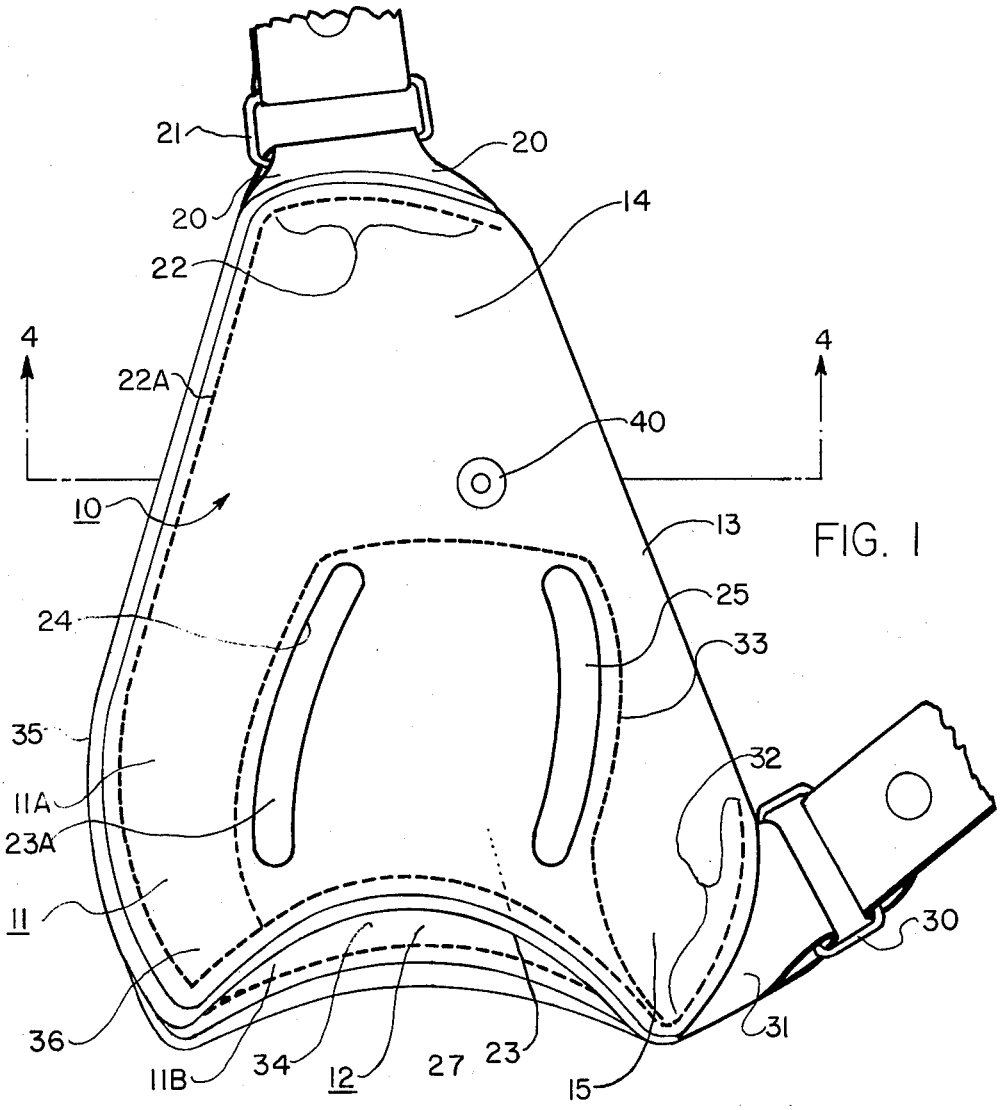
FIG. 1 is a side elevational view of a holster in accordance with this invention.
Figure 2:
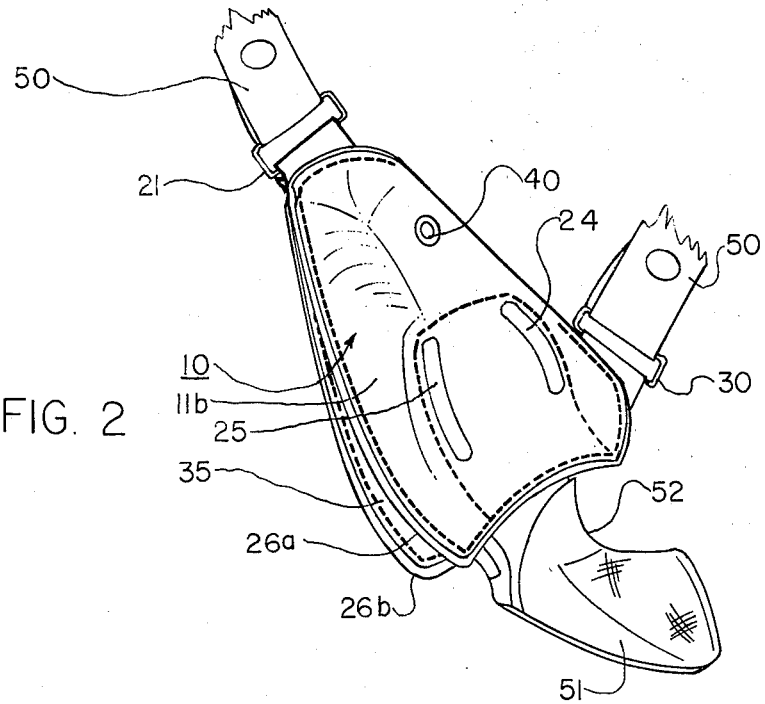
FIG. 2 is a perspective view of a holster in accordance with this invention, worn as an underarm or shoulder holster.

Now referring to FIGS. 1 and 2, a holster 10 in accordance with this invention includes a body or outer facing 11 of leather or leather like material having a pair of sides 11A and 11B which define a weapon receiving pocket 12 between the sides 11A and 11B. Sides 11A and 11B are joined at a fold 13 which extends from the muzzle region 14 to the trigger guard enclosing region 15. The body 11 includes an end fold 20 which holds a D or other shaped ring 21 in its fold with the two outer facings 11A and 11B and the fold 20 secured together by a stitch line 22. An apparent continuation of stitch line 22, namely stitch line 22A actually stitches only the outer face 11A to its inner liner 23 which is visible through a pair of belt loop slots 24 and 25. The stitch line 22A extends along the front opening 35, best seen in FIGS. 2 and 4, around a concave region 27 from which the hand grip of a weapon may extend. A second ring 30 is secured to a fold at tap 31 which is secured to the body sides 11A and 11B by a stitch line 32. An additional stitch line section 33 extends around the belt loop slots 24 and 25 to secure the inner liner 23 to the outer face 11A. The opposite face 11B includes similar stitch lines, again securing that outer face 11B to its inner liner 34 which may be seen at the top opening 12.

Employing the design of this invention, the major portion of the stitching may be accomplished before the holster is folded at 13. Thus, the stitch line 22A and 33 constitute a single continuous line while stitch lines 22 and 32 are done separately after folding, all simplifying assembly of the holster.

Figure 4:
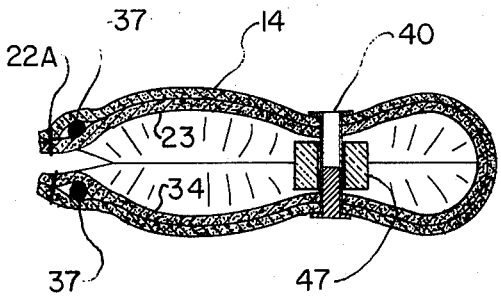
FIG. 4 is a sectional view through the holster along lines 4—4 of FIG. 1.
Figure 7:
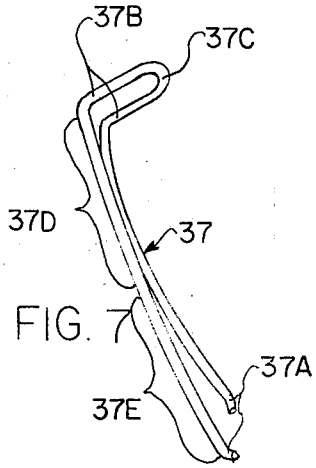
FIG. 7 is a perspective view of the spring of this invention.
Figure 8:
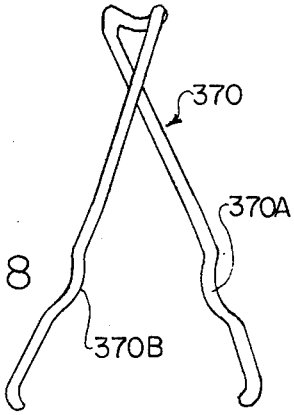
FIG. 8 is a perspective view of an alternate configuration of the spring of FIG. 7.

Features concealed in the holster in FIG. 1 but appearing in FIGS. 4, 7 and 8 are a spring 37 which biases the front opening 35, normally closed, and a pair of cylinder recesses, and positioned in the region of the belt loop slots 24 and 25 in the inner surface of the liner 23 and 34 to retain the revolver cylinder in place. The spring 37 may best be seen in FIGS. 4–8 and the cylinder recesses in FIGS. 5 and 6.

The presence of the tabs 20 and 31 and their loops 21 and 30 allow the entire holster to be worn as a shoulder holster as illustrated in FIGS. 1 and 2. One other feature is apparent in FIG. 1, and that is a screw 40 which extends through the faces 11A and 11B and mechanically biases the two faces 11A and 11B together below or behind the barrel of the weapon. Biasing the holster body together at this point applies a generally uniform pressure against the entire weapon and augments the front casing pressure applied by the internal spring 37. The function of the screw 40 is most clearly seen in FIG. 4.

Of greater importance is that the screw 40 and its internal rubber spacer 47 shown in FIG. 4 provide a fulcrum for the barrel when the weapon is drawn, located below the barrel and in front of the cylinder. So positioned, the drawing of the hand grip and frame forward allows the barrel to pivot against the spacer 47 to aid in drawing.

Figure 3:
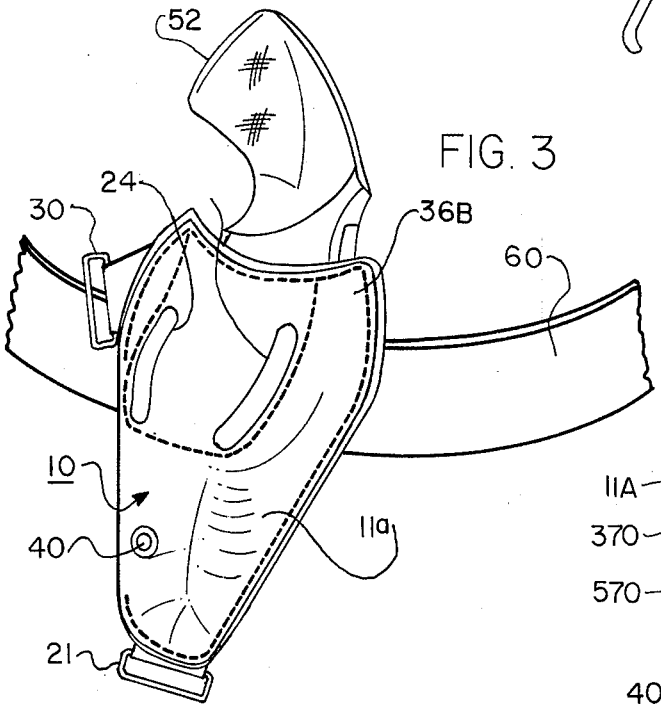
FIG. 3 is a perspective view of a holster of this invention worn on the belt for use by the right hand of the wearer.

Now referring specifically to FIGS. 2 and 3, the two different modes of use of the holster may be clearly seen and compared. In FIG. 2 the holster 10 is supported by opposite ends of a shoulder strap 50 which extends over the shoulder of the wearer in the same general manner as disclosed in U.S. Pat. No. 3,847,315. The ends of the shoulder strap 50 are secured permanently as by rivets or adjustable by snap or other fasteners to the rings 21 and 30 thereby supporting the holster 10 in the armpit region of the wearer with the grip 51 of the weapon 52 in an inverted position but forward for easy cross draw. It should be noted in FIG. 2 that the trigger and trigger guard are concealed within the holster 10 and also the hammer is located between the corners 26A and 36B of the holster 10.

The hammer in its uncocked or safe position is secured between the corners 36A and 36B which are biased inwardly against the side of the hammer whereby the hammer cannot become cocked within the holster or snag on clothing. The regions 36A and B also enclose the rear sight of the weapon 52.

The dual use of the holster and the hammer protection as described above is further apparent in FIGS. 3, 5 and 6. The holster 10 is there illustrated as a front opening belt carried holster for left or right hand draw. The rings 21 and 30 are unused at this time and small enough to provide no interference with the use of the holster. The body assembly 10 is symetrical and therefore the holster may be worn as shown or by passing the belt through either the slots 24 and 25, or 64 and 65. In either case, withdrawal as a front opening holster is accomplished in an easy and reliable manner.

Figure 5:
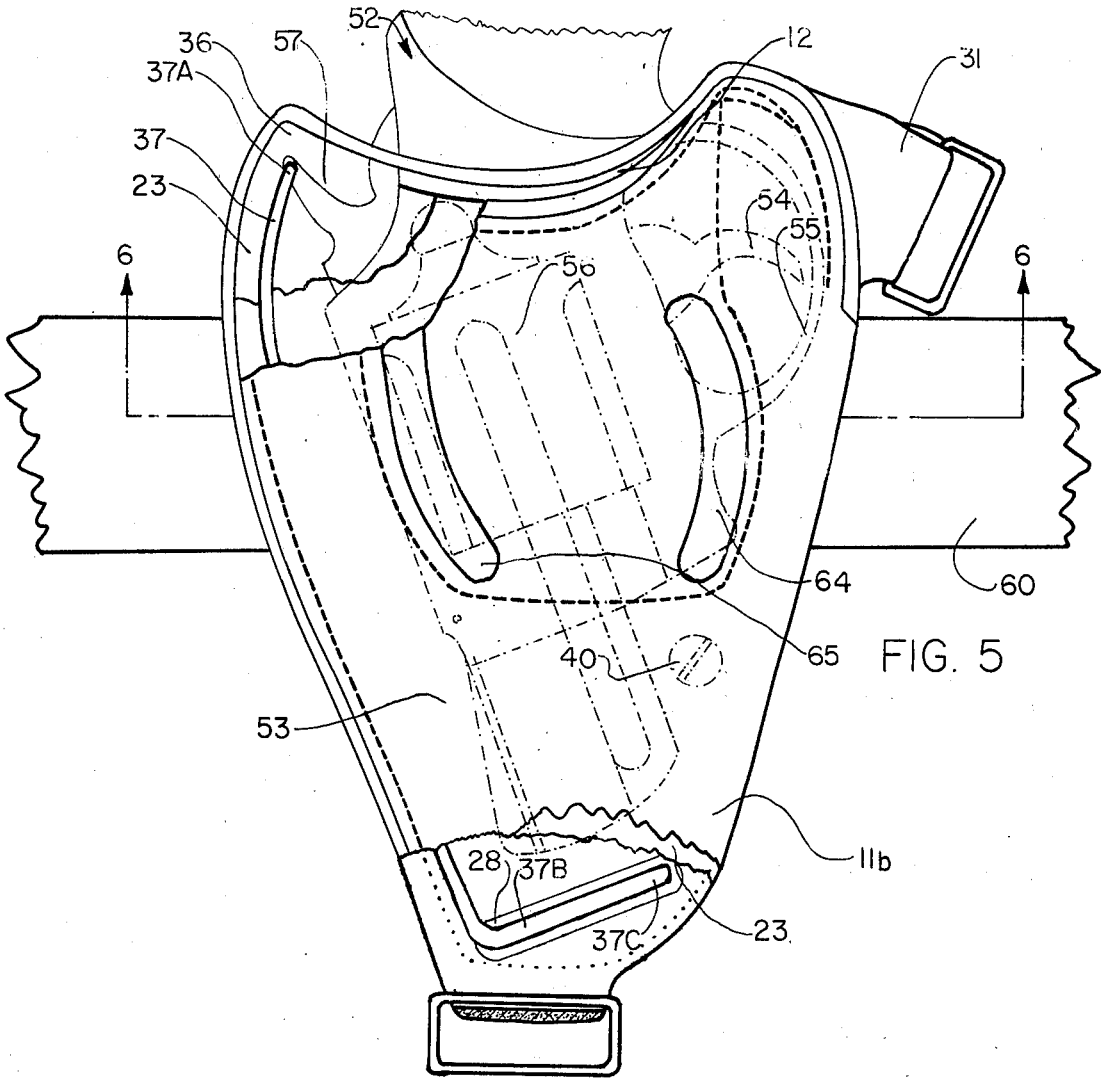
FIG. 5 is an enlarged side elevational view of the holster of this invention on the left side of a belt with portions broken away for clarity with a short barreled revolver shown in phantom by dashed dot lines.
Figure 6:
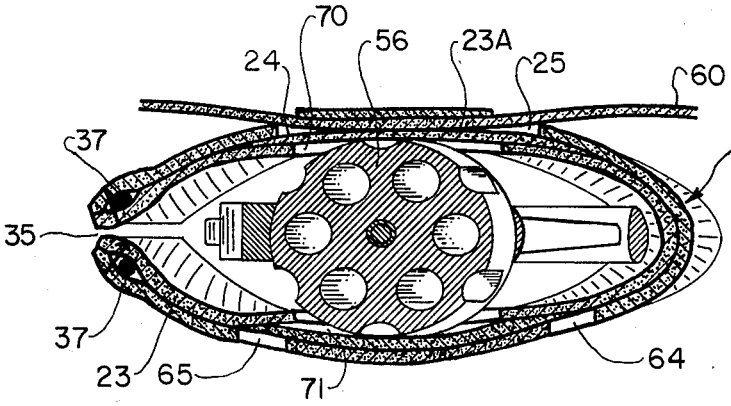
FIG. 6 is a sectional view taken along lines 6—6 of FIG. 5.

Now referring specifically to FIGS. 5 and 6 where significant features of this invention may be clearly seen, in FIG. 5 a revolver 52 is shown in phantom form with the grip 51 extending out of the opening 12, and the barrel 53, trigger 54 and trigger guard 55 and cylinder 56, all enclosed within the holster 10. This position as shown in FIG. 5 is the normal position for the weapon regardless of whether it is worn on a belt as shown in FIG. 5 or as a shoulder holster as in FIGS. 1 and 2. The hammer 57 of the revolver 52 is shown positioned adjacent to the upper end 37A of the spring 37. Of course, the hammer 57 is protected from contact with the spring by the two sides of the liner 23. The rear sight 58 likewise is enclosed between the legs of spring 37. In FIG. 5, the liner sides 23 are broken away to show the relative position of the spring 37 and hammer 57. The trigger 54 and trigger guard 55 are nestled within the opposite corner portion of the holster body below the tab 31. The ends of the crescent shaped opening 12 conceal the trigger and trigger guard at one end and the hammer at the opposite end.

Another feature apparent in FIG. 4 involves the screw 40 and its associated spacer 47. It is apparent that the barrel 53 of the revolver 52 may pivot against the spacer 47 in being rotated forward to withdraw the weapon. This spacer 47 provides a fulcrum against which the weapon is pivoted. It prevents relative movement of the holster on drawing of the weapon and a smooth movement forward.

In as much as the holster of this invention is worn as a concealed shoulder holster, it is desirable to minimize the overall thickness. As we have found in the past, front opening holsters often tend to have an enlargement at the bottom which can provide a visible bulge. I have eliminated this problem in a manner which is illustrated in FIG. 5. Note that the spring 37 is a modified L shape with the foot 37B including a bight portion 37C positioned in a cutout 28 in the liner 23. The liner 23 includes two cutouts, one in each side, therefore defining the recess for the foot 37B of the spring. The spring is not adversely effected at all in its normal operation and the thickness of the bottom of the holster is thereby significantly reduced.

Referring now to FIG. 6, the cylinder 56 of the revolver 52 extends into recesses 70 and 71 in the form of cutouts to liner 23. The cutouts 70 and 71 conform to the side of the cylinder whereby the weapon is effectively prevented from upward withdrawal in the positions shown in FIG. 5, or downward withdrawal as in the positions shown in FIGS. 1 and 2. Between the outer faces 11A and 11B and the liner 23 is a pair of subliners 23A and 23B which seal the belt loop slots and include cylinder recesses to add depth to these recesses.

By comparison of FIGS. 1 and 4 with FIGS. 3 and 5, it may be seen that withdrawal of the weapon is in the forward direction regardless of the manner in which it is worn.

The shape of the spring 37 which makes it compatable with the holster in performing each of the functions described above is best seen in FIGS. 7 and 8. The spring is complex shape including the ends 37A which are bent inward as is apparent in both FIGS. 7 and 8. The spring in its unrestrained form has its legs crossed, as is apparent in FIG. 8. The foot includes a pair of parallel portions which terminate in the bight portion 37C. These parallel foot portions 37B each rest in a respective cutout 28, one of which appears in FIG. 5. Immediately beyond the foot bend are a pair of straight portions 37D joining curved sections 37E. Given the shape, as is best illustrated in FIGS. 7 and 8, the spring 37 effectively closes the front opening 35 of the holster, and its ends 37A effectively bear against the hammer enclosing portion of the holster to provide closing pressure all the way from beyond the end of the barrel to above the hammer. This additional closing force over the full length of the front of the holster provides greater safety in the holding of the weapon, particularly in the inverted form when it must hold the weapon against gravity. The nestling of the foot portions 37B and the bight portion 37C in the mating recesses 28 also minimize the overall thickness of the holster.

In many cases this holster will be used with adjustable rear sight weapons. In such a case it is desired that the rear sight be enclosed but spaced from the holster leather and of course not touched by metal. This is accomplished employing the modified spring of FIG. 8 in place as shown in FIG. 8A.

Figure 8A:
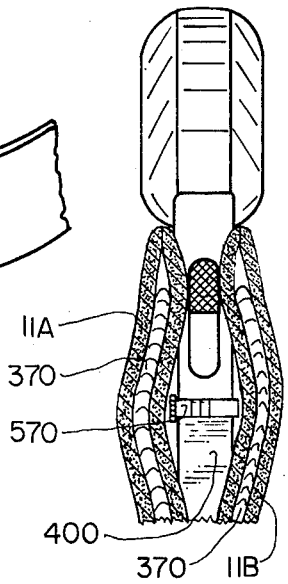
FIG. 8A is a fragmentary view of the hammer and rear sight region of a holster incorporating the spring of FIG. 8.

In FIG. 8, the spring 370 includes mating offset bends 370A and B which define a gap 400 of FIG. 8A. The gap 400 provides clearance around rear sight 570.

The above described embodiments of this invention are merely descriptive of its principles and are not to be considered limiting. The scope of this invention instead shall be determined from the scope of the following claims including their equivalents.

What is claimed is:

1. A holster for handguns comprising a body of leather or leather like material formed to define a weapon holding pocket between two sides thereof;

said body including edges which define an opening extending substantially the full length of one side thereof and generally paralleling the barrel of a handgun held therein;

said body defining an end opening for said weapon holding pocket for access to the grip of a handgun;

said body extending to substantially enclose the hammer of the weapon in the pocket between edge regions of said body;

spring means biasing said body sides together along the barrel of said weapon and including portions extending into the region of the hammer of a handgun in said holster embracing the hammer of such handgun and biasing inward said body portions for substantially enclosing said hammer, whereby said handgun is more positively retained in said holster and the hammer is protected.

2. The combination in accordance with claim 1 wherein said body includes a pair of slots extending therethrough in spaced positions on each side of said body thereby defining a pair of integral belt loops on each side thereof.

3. The combination in accordance with claim 1 wherein said biasing means comprises a unitary spring including a bight portion and a pair of leg portions;

said spring means positioned with the bight portion in the region of the holster adjacent to the muzzle and said leg portions extending up respective sides of the body adjacent to the side opening defined thereby including end regions of said spring means enclosing the hammer of a weapon contained therein.

4. The combination in accordance with claim 1 wherein said spring member is shaped in the general L configuration with the bight at the foot of the L;

said holster including an inner liner extending into the muzzle retaining region of the holster;

said inner liner including a pair of matching recesses, one on each side of the muzzle retaining portion of the holster;

the foot of the L and bight portion of said spring being positioned within said recess whereby the bight and foot portions are concealed from exposure to the muzzle of the weapon in the holster and said spring does not add thickness to the holster in the muzzle retaining region;

the leg portions of said spring positioned between said body and said inner liner to protect the barrel and frame of the weapon from contact with said spring.

5. The combination in accordance with claim 4 wherein said spring member includes the outer end of the leg portions having a curve inward;

said curve extending in the general direction away from the side opening whereby the uppermost portions of said spring biasing said sides inward define a smooth curve in the region of the hammer of the weapon.

6. The combination in accordance with claim 1 wherein the opening for the grip of the weapon is generally crescent shaped with one end region thereof enclosing the trigger portion of the weapon and the other end enclosing the hammer portion of the weapon and the reduced level therebetween allowing free access to the grip of the weapon.

* * * * *